United States Patent [19]

Scott et al.

[11] Patent Number: 4,824,613

[45] Date of Patent: Apr. 25, 1989

[54] VAPOR RETURN PRIMER FOR CARBURETORS OF INTERNAL COMBUSTION ENGINES

[75] Inventors: William A. Scott; Mark A. Hutchinson, both of Mt. Zion, Ill.

[73] Assignee: Tillotson, Ltd., Tralee, Northern Ireland

[21] Appl. No.: 147,747

[22] Filed: Jan. 25, 1988

[51] Int. Cl.[4] ..... F02M 1/16

[52] U.S. Cl. ..... 261/35; 261/36.2 DIG. 8; 261/DIG. 81; 261/DIG. 68

[58] Field of Search ..... 261/DIG. 81, DIG. 8, 261/35, DIG. 68, 36.2

[56] References Cited

U.S. PATENT DOCUMENTS

| | | | |
|---|---|---|---|
| 1,591,331 | 7/1926 | Linebarger | 261/36.2 |
| 3,177,920 | 4/1965 | Phillips | 261/DIG. 68 |
| 3,233,652 | 2/1966 | Phillips | 261/DIG. 8 |
| 3,275,305 | 9/1966 | Nutten | 261/DIG. 68 |
| 3,494,343 | 2/1970 | Nutten | 261/DIG. 68 |
| 3,738,622 | 6/1973 | Tuckey | 261/DIG. 68 |
| 3,805,758 | 4/1974 | May | 261/DIG. 8 |
| 3,807,371 | 4/1974 | Nutton et al. | 261/DIG. 68 |
| 3,978,839 | 9/1976 | Dubois et al. | 261/DIG. 8 |
| 4,271,093 | 6/1981 | Kobayashi | 261/DIG. 68 |
| 4,335,061 | 6/1982 | Kobayashi | 261/DIG. 68 |
| 4,437,448 | 3/1984 | Billingsley | 261/DIG. 8 |
| 4,447,370 | 5/1984 | Kobayashi et al. | 261/DIG. 68 |
| 4,684,485 | 8/1987 | Scott | 261/DIG. 68 |
| 4,735,751 | 4/1988 | Guntly | 261/DIG. 8 |

FOREIGN PATENT DOCUMENTS

| | | | |
|---|---|---|---|
| 54-5136 | 1/1979 | Japan | 261/DIG. 81 |
| 55-156237 | 12/1980 | Japan | 261/DIG. 8 |
| 58-77159 | 5/1983 | Japan | 261/DIG. 81 |
| 59-153964 | 9/1984 | Japan | 261/DIG. 81 |

*Primary Examiner*—Tim Miles

*Attorney, Agent, or Firm*—Harness, Dickey & Pierce

[57] ABSTRACT

A vapor return primer for priming and regulating pressure in a carburetor is disclosed. The vapor return primer includes a housing having an inlet and an outlet. The inlet is coupled with the high pressure side of the carburetor. The outlet is coupled with a fuel tank. A resilient flexible membrane is coupled with the housing for moving fluid through the inlet and outlet to prime the carburetor. A pressure relief mechanism is coupled with the housing to provide one-way flow from the housing through the outlet to the fuel tank during priming. Also, the pressure refief mechanism regulates the carburetor pressure when the internal combustion engine is in a continuous running mode.

6 Claims, 1 Drawing Sheet

VAPOR RETURN PRIMER FOR CARBURETORS OF INTERNAL COMBUSTION ENGINES

BACKGROUND AND SUMMARY OF THE INVENTION

The present invention relates to small internal combustion engines and, more particularly, to vapor return primers for diaphragm carburetors.

Internal combustion engines which utilize diaphragm carburetors are generally faced with a vapor lock problem. The reason that these types of carburetors are susceptible to vapor lock is that diaphragm carburetors are not vented to atmosphere as are float-type carburetors. Thus, there is a need to enable diaphragm carburetors to function without experiencing vapor lock.

Vapor lock is caused by the vaporization of fuel in the carburetor fuel path prior to the entrance of the fuel into the carburetor metering chamber. When a carburetor heats up, generally due to engine heat, causing the fuel in the carburetor to vaporize, fuel vapor and/or emulsion are present at the inlet needle of the carburetor metering chamber. As more fuel is required by the carburetor, the inlet needle opens and the fuel vapor and/or emulsion enter the metering chamber, causing vapor lock. Thus, the carburetor is starved for raw or liquid fuel, and results in lean fuel supply to the engine.

To overcome this dilemma, particularly in large internal combustion engines which utilize diaphragm carburetors such as snowmobiles, and the like, a fuel take off fitting with calibrated orifice is located at high pressure side of the carburetor fuel delivery system to "scalp" off vapor and/or emulsion and return the vapor and emulsion to the fuel tank. As the engine begins to heat up causing the fuel to vaporize in the carburetor, the vaporized fuel is "scalped" off and returned to the fuel tank to enable raw fuel to enter into the metering chamber of the carburetor. When vaporization is not occurring in the carburetor, raw fuel is still "scalped" off to the fuel tank without hampering the function of the carburetor. This is due to the fact that the carburetor fuel pump delivers fuel at such a rate that only about 20% of the fuel delivered is required for functioning of the carburetor. With these large internal combustion engines, an orifice may be calibrated that does not substantially reduce the pressure on the high pressure side of the carburetor and thus, the carburetor is enabled to function.

In small internal combustion engines like the microengines which are utilized in chain saws, weed trimmers and the like, the pressure on the high pressure side of the fuel delivery system is in the order of 2 to 6 PSI. In order to provide the carburetors of these microengines with orifices, a very, very small orifice is needed to keep the pressure on the high pressure side of the fuel delivery system from going to zero causing failure of the carburetor. Orifices which were calibrated to be used in these microengines were so small that dirt or the like in the fuel stream easily blocked the orifice, rendering the orifice inoperable. Thus, there is a need for a device which enables the scalping off of fuel in small internal combustion engines.

The present invention provides the art with a vapor return primer for small internal combustion engines (microengines). The present invention serves the dual purpose of priming a small internal combustion engine prior to starting the engine and scalping off fuel from the carburetor of the internal combustion engine during a continuous running mode to regulate pressure in the carburetor and to prevent vapor lock. The present invention enables the carburetor to run cooler and provide easier starts when the engine is hot. The present invention enables fuels such as gasahol, a gasoline alcohol mixture, to be utilized in small internal combustion engines. Since gasahol vaporizes at a lower temperature than gasoline, the present invention enables the scalping off of the vapor and/or emulsion to enable raw fuel to enter the carburetor metering chamber.

Accordingly, the vapor return primer of the present invention includes a housing having an inlet and an outlet, both to enable passage of fluid through the housing. A resilient flexible membrane is coupled with the housing. The membrane is adapted to be flexed for priming the carburetor. The membrane is flexed from a first original position to a compressed position wherein fluid is expelled from the housing. The membrane reflexes from the compressed position to its original position wherein fluid is drawn into the housing. A pressure relief mechanism is coupled with the housing to regulate pressure in the carburetor and to enable one-way flow of fluid to exit the housing. The pressure relief mechanism also enables fuel to exit the housing during flexing of the membrane and during the continuous running mode of the engine.

From the subsequent detailed description taken in conjunction with the drawings, other objects and advantages of the present invention will become apparent to those skilled in the art.

DETAILED DESCRIPTION OF THE PREFERRED EMBODIMENT

Figure 1:
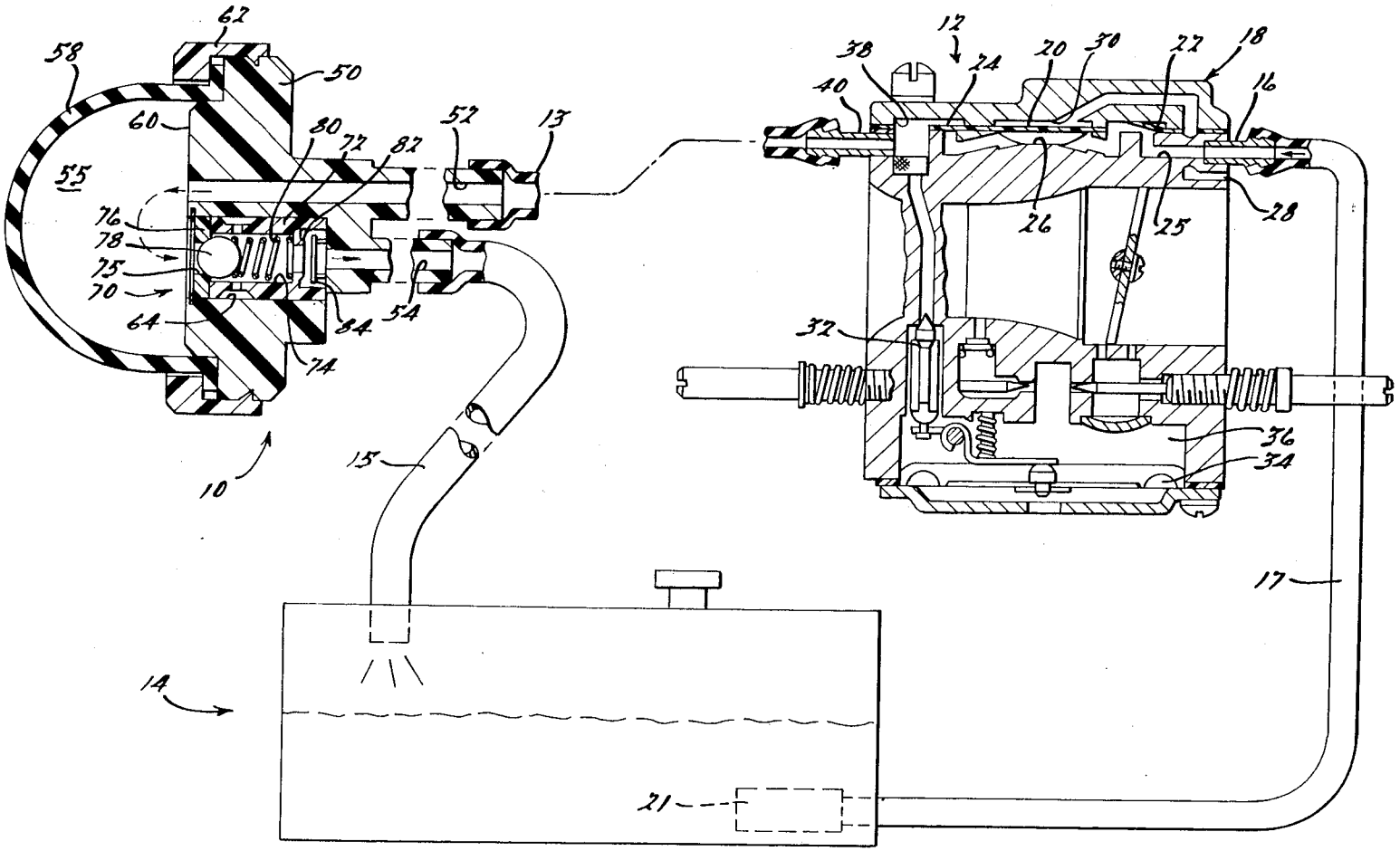
FIG. 1 illustrates a cross-section view of a vapor return primer in accordance with the present invention.

Referring to FIG. 1, a vapor return primer is illustrated and designated with the reference numeral 10. The vapor return primer 10 is coupled with a carburetor 12 and a fuel tank 14 via conduits 13 and 15.

The carburetor 12, in FIG. 1, is of a conventional diaphragm carburetor design. The carburetor 12 includes a fuel inlet 16 coupled with a conduit 17 which enables fuel to pass from the fuel tank 14 into the carburetor 12. The inlet 16 is coupled with a fuel pump 18. The fuel pump 18 is of a diaphragm design and includes diaphragm 20 which has a diaphragm inlet valve 22 and diaphragm outlet valve 24. Fuel travels through the inlet 16 along the low pressure side of the fuel path 25, through the inlet diaphragm 22, into the fuel pump chamber 26 and exits through the fuel diaphragm outlet 24.

When the engine is running, crankcase positive and negative pressures are forced through the impulse channel 28 into the impulse chamber 30 so that the diaphragm 20 is driven to and fro to draw fuel from the fuel tank 14 into the fuel chamber 26. Fuel flows continuously along the high pressure side of the fuel path 38 and is stopped at the carburetor inlet needle valve 32. When the cord of the internal combustion engine is pulled or when the engine is running, the inlet needle valve 32 is opened via diaphragm 34 and fuel enters into the metering chamber 36. The fuel flows from the metering chamber 36 through the discharge ports into the carburetor venturi to provide fuel to the internal combustion engine.

The high pressure side of the fuel path 38 is coupled with an outlet 40. The outlet 40 is coupled with the conduit 13 which, in turn, couples the high pressure side of the carburetor fuel path 38 with the vapor return primer 10.

The vapor return primer 10 includes a housing body 50 having an inlet 52 and an outlet 54. The inlet 52 is connected with the conduit 13 to couple the vapor return primer 10 with the high pressure side of the carburetor fuel path 38. The outlet 54 is coupled with conduit 15 which, in turn, is coupled with the fuel tank 14. The outlet 54 enables fuel to exit the vapor return primer 10, via the conduit 15, into the fuel tank 14.

The housing body 50 has an overall cylindrical shape. A reslient flexible membrane 58 is coupled with the housing body 50. An attachment member 62 secures the membrane 58 to the housing body 50. A hemispherical space 55 is formed between the membrane 58 and the top 60 of the housing body 50. The membrane 58 is compressible into the space 55 for priming the carburetor 12, as will be explained herein.

A pressure relief mechanism 70 is positioned in a bore 64 in the housing body 50. The pressure relief mechanism 70 includes a cylindrical housing 72 positioned within the bore 64. The housing 72 has a central bore 74 which runs the length of the housing 72. An annular seal 76 is positioned at one of the axial ends of the housing 72. A ball valve 78 is resiliently biased by a spring 80 in sealable contact with aperture 75 of the seal 76. A peripheral flange 82 extends radially from the housing wall associated with the axial bore 74 to provide a seat for the spring 80. A one-way valve 84 is positioned at the other axial end in the central bore 74 of the housing 72. The one-way valve 84 along with the ball valve 78 enable fluid to pass from the hemispherical space 55 of the membrane 58 into the fuel tank 14. The one-way valve 84 and ball valve 78 prevent fluid from flowing from the fuel tank 14 into the semi-spherical space 55 between the membrane 58 and the housing body 50.

The vapor return primer 10 functions as a primer prior to starting when the engine is cold or has not been ran. Also, the vapor return primer 10 functions as a vapor return regulating pressure into the carburetor when the engine is running.

When the engine is cold or has not been run for several days, the fuel within the metering chamber 36 and pump chamber 26 generally evaporates and no fuel is present to start the internal combustion engine. To prime the carburetor, the primer membrane 58 is depressed several times, like a conventional bulb primer. As the membrane is depressed or flexed, fluid or air in the space 55, is forced through the pressure relief mechanism 70 and outlet 54 into the fuel tank 14. As the membrane 58 reflexes from its flexed or compressed position back to its original position, fluid is drawn from the carburetor 12, via inlet 40, conduit 13 and inlet 52, into the space 55 of vapor return primer 10. Further, as the membrane 58 reflexes back to its original position, fluid is prevented from being drawn from the fuel tank 14 into the vapor return primer 10, via outlet 54 and conduit 15, by one-way valve 84 and ball valve 78 of the pressure relief mechanism 70. Thus, as the membrane 58 reflexes back to its original position fuel is drawn from the fuel tank 14 through filter 21 through conduit 17 and into the carburetor 12.

The fuel drawn into the carburetor 12 by the vapor return primer 10 fills the high pressure side of the fuel path 38 up to the needle inlet valve 32. As the cord on the internal combustion engine is pulled, the action of the carburetor diaphragm 34 opens the needle valve 32 enabling fuel to be drawn into the metering chamber 36. After sufficient fuel is in the metering chamber 36 it passes into the venturi, the engine fires and begins to run.

Once the engine starts and is in a continuous running mode, the fuel pump 18 supplies the carburetor 12 with a continuous stream of fuel. The fluid in the high pressure side fuel path 38 of the carburetor pump 18 is ordinarily under a pressure of about 2 to about 6 PSI when a vapor return primer 10 is not present in the system. As the carburetor continues to run excess engine heat associated with the carburetor may cause the fuel in the high pressure side of the fuel path 38 to vaporize causing a vapor lock condition in the carburetor 12. At this time, the vapor return primer 10 regulates pressure in the carburetor and functions as a vapor return. Also, the vapor return primer 10 scalps off raw or liquid fuel when the fuel is not vaporized. This scalping does not adversely effect the carburetor and, in fact, enhances its function, as will be explained herein.

Fluid is scalped off of the high pressure side of the carburetor 12 by the vapor return primer 10. This scalping is accomplished by the calibration of the spring 80 along with dynamic vibration of the internal combustion engine to which the vapor return primer 10 is mounted. The spring 80 is calibrated such that the metallic ball valve 78 is enabled to move away from the seal 76 to enable fluid to be scalped from the carburetor and pass into the fuel tank 14 while maintaining or regulating the pressure on the high pressure side of the carburetor within a desied range. The pressure on the high pressure side of the carburetor preferably is between about 2 to 6 PSI, however, the pressure may be between about 1 to 3 PSI and enable sufficient functioning of the internal combustion engine.

The scalping off of the fuel enables the carburetor 12 to experience mostly raw or liquid fuel. The vapor return primer 10 removes any vapor, emulsion or the like from the high pressure side of the carburetor enabling smoother functioning of the carburetor. The dynamic vibration of the internal combustion engine is believed to be coupled with the calibrated spring 80 to enhance the functioning of the pressure relief mechanism 70. It is believed that vibration makes the vapor return primer act nonlinear. The nonlinearity enables the vapor return primer 10 to compensate in the lower PSI range of the high pressure side of the carburetor to enhance the functioning of the vapor return primer 10.

The scalping off of fuel to the vapor return primer 10 enables a high rate of fluid flow through the fuel pump assembly 18. Since the carburetor utilizes only about 20% of the pump fuel rate per unit time, the scalping off of raw or liquid fuel does not effect the functioning of the carburetor. This high rate of fuel passing through the fuel pump 18 provides a cooling effect to the pump assembly 18 and carburetor 12. This has a profound effect on the cool down rate of the carburetor body. This fast cool down rate in conjunction with substantially all the vapor being returned to the fuel tank 14, via the vapor return primer 10, vastly reduces the adverse effects experienced during hot re-starting. After repeated priming of primer bulb 10 prior to hot re-start the carburetor 12 has raw or liquid fuel at the time of hot start of the engine and is more likely to begin running since it should not experience a vapor lock condition, providing priming has substantially cooled the pump chamber 26.

The present invention enables fuel such as gasahol, which vaporizes at a much lower temperature than gasoline, to be used in small internal combustion engines. As fuel vaporizes, it is drawn from the carburetor 12 into the vapor return primer 10 and is exited to the fuel tank 14. Thus, the carburetor 12 continuously sees raw or liquid fuel and attempts to operate at its optimum efficiency.

While the above summarizes the preferred embodiment of the present invention, it will become apparent to those skilled in the art that modifications, variations and alterations may be made to the present invention without deviating from the scope and fair meaning of the subjoined claims.

What is claimed is:

1. In combination, a vapor return primer and a diaphragm carburetor, the carburetor having a fuel chamber with a high pressure side and the carburetor associated with an internal combustion engine, the vapor return primer comprising:

a housing having an inlet and outlet;

conduit means coupling said inlet with said fuel chamber high pressure side;

second conduit means coupling said outlet with a fuel tank;

a resilient flexibe membrane coupled with said housing, said resilient membrane for priming said carburetor such that said membrane is fixed from a first original position to a second compressed position wherein fluid is expelled from said housing into said fuel tank and upon said membrane reflexing back to the first original position fluid is drawn from said carburetor into said housing; and pressure relief means for enabling fluid to pass into said fuel tank while said membrane is being compressed and preventing said fluid from entering said fuel tank when said memberane reflexes to said first original position, and for regulating pressure of said carburetor enabling fluid to flow from said carburetor to said fuel tank while pressure in said carburetor is at a desired pressure while said engine is running, said pressure relief means coupled with said outlet and said housing.

2. The apparatus according to claim 1 wherein said pressure relief means includes a seal member, a ball valve resiliently biased against said seal member for regulating pressure in said carburetor and monitoring flow through said outlet and a one-way valve for enabling one-way flow from said vapor return primer through said outlet to said fuel tank.

3. The apparatus according to claim 1 wherein said ball valve being biased by a spring, said spring calibrated such that said ball valve is responsive to pressure in said carburetor so that pressure in said carburetor is regulated at a desired level while fluid flow is enabled to pass through said pressure relief means of said vapor return primer to said fuel tank.

4. The apparatus according to claim 1 wherein said vapor return primer is responsive to vibration of said internal combustion engine enabling pressure in said carburetor to remain at desired regulated pressure while enabling fluid flow to pass through said vapor return primer to said fuel tank.

5. The apparatus according to claim 4 wherein said pressure relief means includes a seal member, a ball valve resiliently biased against said seal member for regulating pressure in said carburetor and monitoring flow through said outlet and a one-way valve for enabling one-way flow from said vapor return primer through said outlet to said fuel tank.

6. The apparatus according to claim 5 wherein said ball valve being biased by a spring, said spring calibrated such that said ball valve is responsive to pressure in said carburetor so that pressure in said carburetor is regulated at a desired level while fluid flow is enabled to pass through said vapor return primer to said fuel tank.

* * * * *